United States Patent [19]

Danielak et al.

[11] Patent Number: 4,979,748

[45] Date of Patent: Dec. 25, 1990

[54] TOKEN ALIGNING THREE-DIMENSIONAL STRATEGY GAME AND METHOD OF PLAY

[75] Inventors: Ann C. Danielak, Wilmette; Jeffrey Breslow, Highland Park,, both of Ill.

[73] Assignee: Marvin Glass & Associates, Chicago, Ill.

[21] Appl. No.: 306,197

[22] Filed: Feb. 2, 1989

[51] Int. Cl.[5] ..... A63F 3/00

[52] U.S. Cl. ..... 273/241; 273/271

[58] Field of Search ..... 273/241, 271, 153 S, 273/144 R, 144 A, 144 B, 287

[56] References Cited

U.S. PATENT DOCUMENTS

| | | | |
|---|---|---|---|
| 3,534,964 | 10/1970 | Guill | 273/144 A |
| 4,585,234 | 4/1986 | Alsip | 273/271 |
| 4,645,209 | 2/1987 | Goulter et al. | 273/271 |

*Primary Examiner*—Benjamin Layno

*Attorney, Agent, or Firm*—John S. Pacocha

[57] ABSTRACT

A token aligning three-dimensional strategy game for a number of players includes aligned tubes defining passageways with each tube having an opaque upper portion and a transparent lower portion. Graphically distinguished sets of tokens are provided for each player. The tokens are capable of passing from the top of the opaque upper portion through to the bottom of the transparent lower portion. However, passage of the tokens is blocked by a removable pin extending through all of the passageways so that tokens are retained in the opaque upper portion until the pin is pulled. Each player, in turn, place tokens in the passageways attempting to obtain a predetermined number of the tokens in a line. Once a player thinks the required alignment has been achieved in the opaque upper portion, the player pulls the pin and all of the tokens drop down into the transparent lower portion to disclose whether or not the alignment has been achieved.

17 Claims, 1 Drawing Sheet

TOKEN ALIGNING THREE-DIMENSIONAL STRATEGY GAME AND METHOD OF PLAY

BACKGROUND OF THE INVENTION

1. Field of the Invention

This invention relates generally to games and more particularly to token aligning three-dimensional strategy games.

2. Background Art

Token aligning three-dimensional strategy games are old in the art. U.S. Pat. Nos. 2,313,473 issued Mar. 9, 1943 to Heacock et al.; U.S. Pat. No. 2,485,143 issued Oct. 18, 1949 to Duncan; U.S. Pat. No. 2,801,107 issued July 30, 1957 to Greer, Jr.; and U.S. Pat. No. 4,119,320 issued Oct. 10, 1978 to Chorba et al. all show structures for playing three-dimensional tic-tac-toe or other token aligning three-dimensional strategy games. Although not a strategy game, U.S. Pat. No. 2,665,915 issued Jan. 12, 1954 to Steig discloses a gaming device in which a number of differently colored balls are enclosed in a container having an opaque, bulbous portion and a transparent tubular portion; a player grasps the tubular portion, mixes up the balls by shaking the container and then inverts it to display a chance arrangement of a predetermined number of the colored balls and then determines a score from the chance arrangement. The prior art token aligning three-dimensional games do not sufficiently test the player's memory or recollection ability in that the position of all of the tokens are exposed to view. Accordingly, there remains a need for a token aligning three-dimensional strategy game which provides for greater variations in play by obscuring the placement of the player's tokens during the course of play.

SUMMARY OF THE INVENTION

The present invention is concerned with providing a token aligning three-dimensional strategy game in which the placement of the player's tokens is obscured from view until exposed by one of the players. A number of identical elongated, hollow, tubular columns extend upwardly from a base. Each of the columns has an opaque upper portion and a transparent lower portion. Graphically distinguished sets of tokens are provided for each player with each token fitting into and being capable of passing from the top of the upper portion to the bottom of the lower portion of each of the columns. Extending across each of the columns adjacent the junction of the upper portion and the lower portion is a removable pin that blocks the passage of the tokens until released by a player. Players take turns inserting a token into a selected one of the columns attempting to obtain a predetermined number of their own tokens in a line. When a player thinks that the required alignment has been achieved in the opaque, upper portions, the player pulls the pin and all of the tokens drop down into the lower transparent portions to show whether the alignment has actually been achieved or not.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
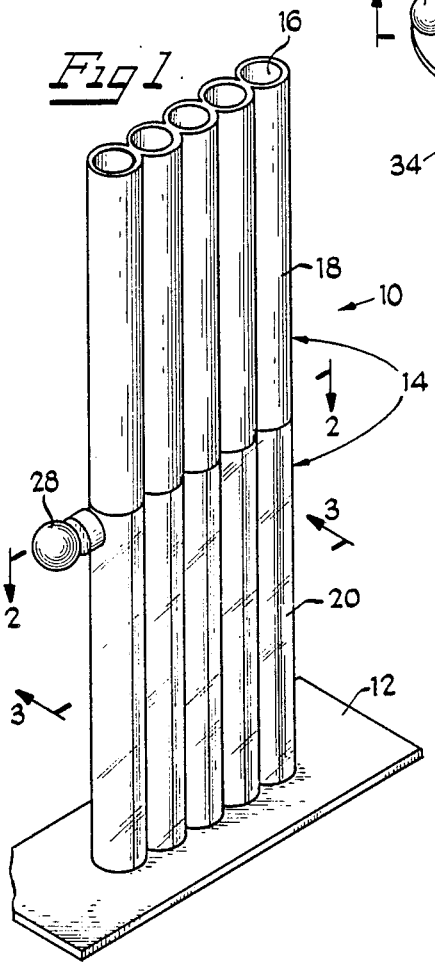
FIG. 1 is a perspective view of an embodiment of the present invention.
Figure 2:
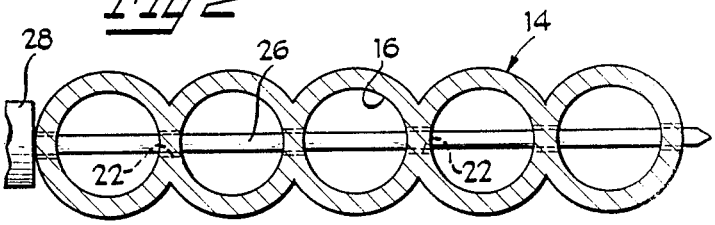
FIG. 2 is an enlarged scale, sectional view taken generally along line 2—2 of FIG. 1.

Referring now to the drawings in which like parts are designated by like reference numerals throughout the several views, FIG. 1 shows a game 10 having a base 12 with five identical, elongated hollow tubular columns 14 mounted on the base and extending upwardly from the base. The axes of the five tubes are generally perpendicular to the base and parallel to each other lying in substantially the same vertical plane so that the five tubes are generally aligned in a single straight line. Each tubular column 14 defines a passageway 16 and has an opaque upper portion 18 plus a transparent lower portion 20. Conveniently, the upper portion and the lower portion are of substantially the same height.

Passing through diametrically opposed sides of each of the tubular passageways is a hole 22. All of the holes 22 are aligned and extend through the sides immediately below the junction of upper opaque portion 18 and lower transparent portion 20. Removably insertable through aligned holes 22 is a pin 26. A cap 28 is secured on one end of pin 26 to provide a convenient handle for insertion and removal of the pin as well as to provide a stop limiting the insertion of the pin into the holes. While each passageway 16 could be provided with its own individual pin, a single pin extending across all of the passageways is more economical and provides a more dramatic effect when all of the tokens are simultaneously released to drop down into the lower transparent portion.

Figure 3:
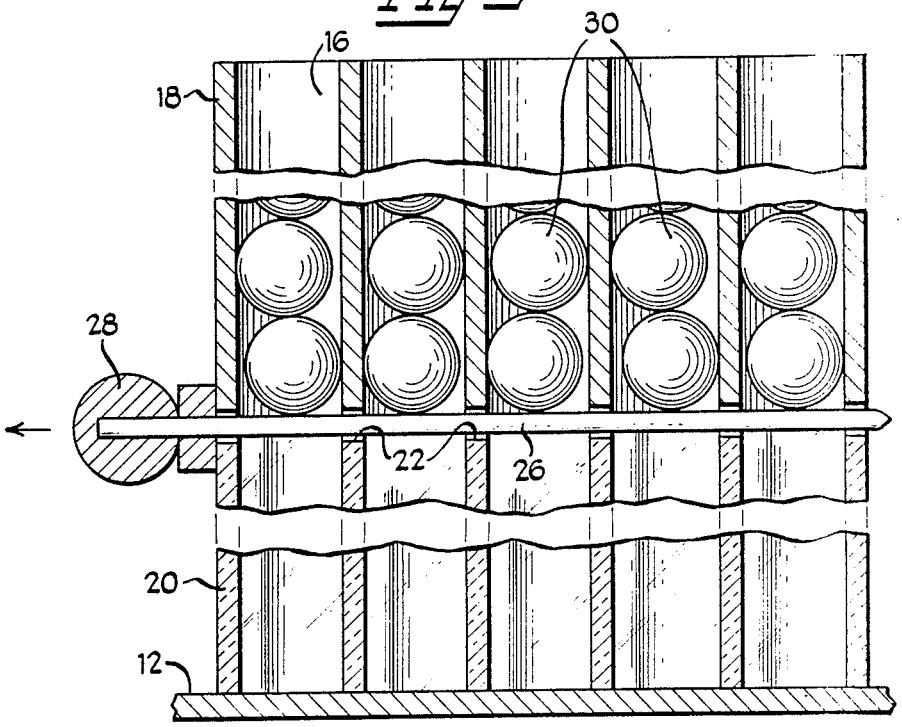
FIG. 3 is an enlarged scale, sectional view taken generally along line 3—3 of FIG. 1.

Each player is provided with a set of tokens 30 conveniently in the form of balls or marbles. All of the tokens of a set are of the same color or other graphic identification and each set is graphically distinguished from every other set. Tokens 30 are of a size that fits easily into each passageway 16. With a set of five columns, each set should include at least five tokens and the height of the opaque upper portion should be great enough to accommodate five tokens stacked one atop the other. As is best illustrated in FIG. 3, although each token 30 easily fits into passageway 16, pin 26 blocks the passage of the tokens from opaque upper portion 18 down into transparent lower portion 20.

To play the game, each player is allocated a set of the graphically distinguished tokens 30. In turn, each player places one token into a selected one of passageways 16 attempting to obtain a predetermined number of the assigned tokens in a line. While the number of columns or passageways limits the maximum number of tokens required to be aligned, a smaller number may also be used to make play easier. As the players insert the tokens into passageways 16, the tokens drop down to the bottom of opaque upper portion 18 but are blocked from further passage down into transparent lower portion 20 by pin 26. When a player thinks the required alignment has been achieved in the opaque upper portion, the player pulls pin 26 out in the direction of the arrow shown in FIG. 3 and all the tokens drop down into the transparent lower portion to disclose whether or not the alignment has actually been achieved.

Figure 4:
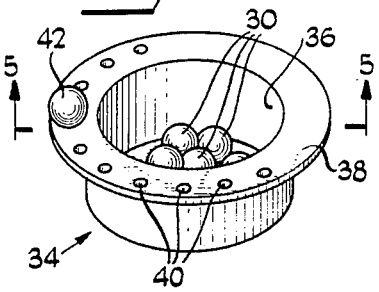
FIG. 4 is a perspective view of an accessory.
Figure 5:
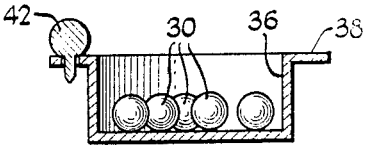
FIG. 5 is a sectional view taken generally along line 5—5 of FIG. 4.

FIGS. 4 and 5 show an accessory 34 which both provides a receptacle for tokens 30 that have not yet been inserted into passageways 16 as well as providing a scorekeeping device. Accessory 34 is conveniently in the form of a cup 36 having a rim 38. Spaced in regular intervals around rim 38 are a series of holes 40 into which a marker 42 fits. If desired, a graphic indication may be placed adjacent each hole 40 to further facilitate keeping score.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A token aligning three-dimensional strategy game for a number of players comprising in combination:

a base;

a plurality of identical, elongated hollow columns defining passageway;

the columns being mounted on the base and extending upwardly from the base;

each column being generally parallel to the other columns;

each column having a transparent lower portion and a contiguous opaque upper portion;

a set of tokens for each player;

each set of tokens being graphically distinguished from every other set;

each token fitting into each of the passageways and being capable of passing from the top of the upper portion of a column to the bottom of the lower portion of the same column; and means blocking the passage of tokens from the upper portions of the columns to the lower portions of the columns until released by a player.

2. The game of claim 1 in which:

the columns are tubes; and the tokens are balls.

3. A token aligning three-dimensional strategy game for a number of players comprising in combination;

a base;

a plurality of identical, elongated hollow columns defining passageways;

the columns being mounted on the base and extending upwardly from the base;

each column being generally parallel to the other columns;

each column having a transparent lower portion and an opaque upper portion;

a set of tokens for each player;

each set of tokens being graphically distinguished from every other set;

each token fitting into each of the passageways and being capable of passing from the top of the upper portion of a column to the bottom of the lower portion of the same column; and a removable pin extending through each column adjacent a junction of the upper portion and the lower portion to block the passage of the tokens through the hollow column from the upper portions of the columns to the lower portions of the columns until released by a player.

4. The game of claim 1 in which the columns are arranged in a single straight line.

5. The game of claim 3 in which the tokens are balls.

6. The game of claim 3 in which the columns are arranged in a single straight line.

7. A token aligning three-dimensional strategy game for a number of players comprising in combination;

a base;

a plurality of identical, elongated hollow columns defining passageways;

the columns being mounted on the base and extending upwardly from the base;

each column being generally parallel to the other columns;

the columns being arranged in a single straight line;

each column having a transparent lower portion and an opaque upper portion;

a set of tokens for each player;

each set of tokens being graphically distinguished from every other set;

each token fitting into each of the passageways and being capable of passing from the top of the upper portion of a column to the bottom of the lower portion of the same column;

each passageway having a hole in opposed sides of the column defining the passageway adjacent a junction of the upper portion and the lower portion;

all of the holes being aligned; and a single, removable pin extending through the aligned holes to block the passage of the tokens through the hollow column from the upper portions of the columns to the lower portions of the columns until released by a player.

8. The game of claim 1 including:

an accessory;

the accessory providing a receptacle for the tokens not inserted into the passageways; and means for keeping score.

9. The game of claim 7 in which the tokens are balls.

10. A token aligning three-dimensional strategy game for a number of players comprising in combination:

a base;

a plurality of identical, elongated hollow columns defining passageways;

the columns being mounted on the base and extending upwardly from the base;

each column being generally parallel to the other columns;

each column having a transparent lower portion and an opaque upper portion;

a set of tokens for each player;

each set of tokens being graphically distinguished from every other set;

each token fitting into each of the passageways and being capable of passing from the top of the upper portion of a column to the bottom of the lower portion of the same column;

means blocking the passage of tokens from the upper portions of the columns to the lower portions of the columns until released by a player;

an accessory providing a receptacle for the tokens not inserted into the passageways;

means for keeping score;

the receptacle being a cup having a rim; and the scorekeeping means comprising holes spaced apart at intervals around the rim and a marker selectively insertable into each of the holes.

11. The game of claim 10 in which the tokens are balls.

12. The game of claim 10 in which the means comprise a removable pin extending through each column adjacent a junction of the upper portion and the lower portion to block the passage of the tokens through the hollow column.

13. The game of claim 10 in which the columns are arranged in a single straight line.

14. The game of claim 13 in which:

each passageway has a hole in opposed sides of the column defining the passageway adjacent a junction of the upper portion and the lower portion;

all of the holes are aligned; and the means comprises a single, removable pin extending through the aligned holes to block the passage of the tokens through the hollow column.

15. A token aligning three-dimensional strategy game for a number of players comprising in combination:

a base;

a plurality of identical, elongated hollow columns defining passageways;

the columns being mounted on the base and extending upwardly from the base;

each column being generally parallel to the other columns;

the columns being arranged in a single straight line;

each column having a transparent lower portion and an opaque upper portion;

a set of tokens for each player;

each set of tokens being graphically distinguished from every other set;

each token fitting into each of the passageways and being capable of passing from the top of the upper portion of a column to the bottom of the lower portion of the same column;

means blocking the passage of tokens from the upper portions of the columns to the lower portions of the columns until released by a player; and the blocking means extending across all of the passageways in a direction parallel to the single straight line adjacent a junction of the upper portion and the lower portion of each column and being movable in the direction parallel to the single straight line to simultaneously release the tokens for passage from the upper portion of each column to the lower portion of the same column.

16. The game of claim 15 in which the tokens are balls.

17. A method of playing a token aligning three-dimensional strategy game by a number of players comprising the steps of:

providing a plurality of passageways each having an opaque upper portion and a transparent lower portion;

allocating a set of tokens to each player that is graphically distinguished from all other tokens for insertion into the passageways;

blocking passage of the tokens from the opaque upper portion of each passageway into the transparent lower portion of each passageway;

permitting each player in turn to insert one of the player's allocated tokens into a selected one of the passageways in an attempt to achieve a required alignment of a predetermined number of tokens; and a player releasing the blocking of the tokens so that they may pass from the opaque upper portion into the transparent lower portion to determine whether the required alignment has been achieved when the player believes the required alignment has been achieved.

* * * * *